US007396114B2

(12) United States Patent
Ishizawa et al.

(10) Patent No.: US 7,396,114 B2
(45) Date of Patent: Jul. 8, 2008

(54) LIQUID CONTAINER

(75) Inventors: Taku Ishizawa, Nagano-Ken (JP); Hitotoshi Kimura, Nagano-Ken (JP); Satoshi Shinada, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 273 days.

(21) Appl. No.: 11/042,754

(22) Filed: Jan. 25, 2005

(65) Prior Publication Data

US 2005/0179752 A1 Aug. 18, 2005

(30) Foreign Application Priority Data

Jan. 30, 2004 (JP) ..... 2004-023879

(51) Int. Cl.
*B41J 2/175* (2006.01)

(52) U.S. Cl. ..... 347/86; 347/85

(58) Field of Classification Search ..... 347/86, 347/85

See application file for complete search history.

(56) References Cited

U.S. PATENT DOCUMENTS

| | | | | |
|---|---|---|---|---|
| 4,558,326 | A * | 12/1985 | Kimura et al. | 347/30 |
| 5,903,294 | A | 5/1999 | Abe et al. | |
| 6,578,947 | B1 * | 6/2003 | Suwabe et al. | 347/29 |
| 6,634,738 | B1 * | 10/2003 | Shinada et al. | 347/86 |
| 6,663,234 | B2 | 12/2003 | Roof et al. | |
| 7,033,005 | B2 * | 4/2006 | Nakamura | 347/85 |
| 2002/0113853 | A1 * | 8/2002 | Hattori et al. | 347/86 |
| 2003/0052951 | A1 * | 3/2003 | Ujita et al. | 347/86 |
| 2003/0071874 | A1 | 4/2003 | Ishizawa et al. | |
| 2003/0071881 | A1 * | 4/2003 | Toba et al. | 347/86 |
| 2003/0140694 | A1 * | 7/2003 | Usui et al. | 73/290 V |
| 2003/0227524 | A1 * | 12/2003 | Yamada et al. | 347/85 |

FOREIGN PATENT DOCUMENTS

| | | | |
|---|---|---|---|
| CN | 1358137 | A | 7/2002 |
| CN | 1358137 | A | 7/2002 |
| EP | 0 849 085 | A2 | 6/1998 |
| EP | 1 232 869 | A1 | 8/2002 |
| JP | 02-214665 | A | 8/1990 |
| JP | 04-100854 | U | 9/1992 |

(Continued)

OTHER PUBLICATIONS

Office Action received in Chinese patent appln. No. 200510005329.8 (Dec. 8, 2006), and English translation.

*Primary Examiner*—An H. Do
*Assistant Examiner*—Sarah Al Hashimi
(74) *Attorney, Agent, or Firm*—Stroock & Stroock & Lavan LLP

(57) ABSTRACT

The liquid container includes: a container body having a built-in closed storage space for storing liquid, a liquid leading-out path for sending liquid in the storage space to a liquid consumption apparatus, an opening at one end thereof being opened on an outer surface of the container body and an opening at the other end thereof being opened in the storage space, a pressurized fluid introducing path for introducing a pressurized fluid into the storage space, an opening at one end thereof being opened on the outer surface of the container body and an opening at the other end thereof being opened in the storage space, and resistance generation unit arranged in the storage space for giving a resistance to a liquid flow in the storage space.

1 Claim, 10 Drawing Sheets

FOREIGN PATENT DOCUMENTS

| | | | |
|---|---|---|---|
| JP | 8-25644 | A | 1/1996 |
| JP | 8-197743 | A | 8/1996 |
| JP | 10-787 | A | 1/1998 |
| JP | 10-166610 | A | 6/1998 |
| JP | 2001-63089 | A | 3/2001 |
| JP | 2002-19135 | A | 1/2002 |
| JP | 2002-307710 | A | 10/2002 |
| JP | 2003-1854 | A | 1/2003 |
| JP | 2003-251818 | A | 9/2003 |

* cited by examiner

LIQUID CONTAINER

CROSS REFERENCE TO RELATED APPLICATIONS

This application is based upon and claims the benefit of priority from the prior Japanese Patent Application No. 2004-23879, filed on Jan. 30, 2004, the entire contents of which are incorporated herein by reference.

BACKGROUND OF THE INVENTION

1. Field of the Invention

The present invention relates to a liquid container for storing a liquid such as ink fed to a liquid consumption apparatus such as an ink jet recording apparatus.

2. Description of the Related Art

As a representative example of a conventional liquid consumption apparatus, there is a liquid ejecting apparatus for ejecting liquid drops from an ejecting head and as a representative example of the liquid ejecting apparatus, there is an ink jet recording apparatus having an ink jet recording head for image recording. The ink jet recording apparatus makes comparatively little noise during printing and can form small dots of high density, so that in recent years, it is used for many types of print including color print.

As a liquid feed method for a liquid consumption apparatus represented by an ink jet recording apparatus, there is a method for feeding a liquid to a liquid consumption apparatus from a liquid container storing the liquid. Furthermore, in the liquid feed method by the liquid container, to enable a user to simply exchange the liquid container at the point of time when the liquid in the liquid container is consumed, the liquid container is generally structured as a cartridge removably mounted on the liquid consumption apparatus.

Generally, the ink jet recording apparatus has a carriage moving back and forth along the recording face of a recording medium having a loaded recording head for injecting ink drops and as an ink feed method from an ink cartridge to a recording head, there is a method with the ink cartridge mounted in the carriage for feeding ink from the ink cartridge moving back and forth together with the recording head to the recording head. Further, as another method, there is a method with the ink cartridge mounted in the case of the apparatus body for feeding ink from the ink cartridge to the recording head via an ink flow path made of a flexible-tube.

Meanwhile, when sending ink in the ink cartridge toward the recording head, there is a method for pressurizing ink in the ink cartridge by a pressurized fluid such as compressed air. By this method, ink can be stably fed against a fluid resistance generated between the ink cartridge and the recording head. As one method for pressurizing ink, there is a method for allowing compressed air introduced into the ink cartridge to make contact with ink and directly pressurizing the ink.

However, in the method for directly pressurizing ink in the ink cartridge by compressed air, a problem arises that when the pressurizing to ink is released, back-flowed compressed air is jetted from the pressurized fluid introducing port formed in the ink cartridge and in correspondence to it, ink leaks from the pressurized fluid introducing port.

An example of a countermeasure for responding to this problem is disclosed in Japanese Patent Laid-Open Publication No. 2002-307710 and here, a structure that ink leaking from the air introducing port flows back into the ink tank is proposed when it is pressurized again.

SUMMARY OF THE INVENTION

However, in the structure proposed in Japanese Patent Laid-Open Publication No. 2002-307710 mentioned above, a problem arises that the periphery of the air introducing port is contaminated by ink, and an on-off valve must be installed at the air introducing port, and furthermore, a special structure for preventing ink leaking from the air introducing port from leaking outside is necessary.

The present invention was developed with the foregoing in view and is intended to provide a liquid container using a way for directly pressurizing a liquid in the liquid container by a pressurized fluid such as compressed air introduced into the liquid container, wherein a liquid can be prevented from leaking through a pressurized fluid introducing port of the liquid container when the pressurizing by the pressurized fluid is released.

The present invention, to solve the aforementioned problems, provides a liquid container for storing a liquid to be fed to a liquid consumption apparatus, comprising: a container body having a built-in closed storage space for storing said liquid, a liquid leading-out path for sending said liquid in said storage space to said liquid consumption apparatus, an opening at one end thereof being opened on an outer surface of said container body and an opening at the other end thereof being opened in said storage space, a pressurized fluid introducing path for introducing a pressurized fluid into said storage space, an opening at one end thereof being opened on said outer surface of said container body and an opening at the other end thereof being opened in said storage space, and resistance generation means arranged in said storage space for giving a resistance to a liquid flow in said storage space.

Preferably, said resistance generation means has a porous member for impregnating a liquid.

Preferably, a density of said porous member in the neighborhood of said opening of said liquid leading-out path on a storage space side is higher than a density at the other parts of said porous member.

Preferably, the liquid container further comprises a high-density part forming projection for compressing said porous member existing in the neighborhood of said opening of said liquid leading-out path on said storage space side, thereby forming a high-density part in the porous member.

Preferably, a density of said porous member in the neighborhood of said opening of said pressurized fluid introducing path on a storage space side is lower than a density at the other parts of said porous member.

Preferably, said porous member has a low-density porous member arranged in the neighborhood of said opening of said pressurized fluid introducing path on said storage space side and a high-density porous member arranged on the other parts.

Preferably, a space where said porous member does not exist is formed around said opening of said pressurized fluid introducing path on said storage space side.

Preferably, the liquid container further comprises a space reservation projection for compressing said porous member so as to keep said porous member away from said opening of said pressurized fluid introducing path on said storage space side, thereby preventing said porous member from existing around said opening of said pressurized fluid introducing path on said storage space side.

Preferably, said space reservation projection is a rib formed integrally with said container body on an inner wall of said storage space.

Preferably, said opening of said liquid leading-out path on said storage space side is positioned on a forward part of said storage space and said opening of said pressurized fluid introducing path on said storage space side is positioned on a backward part of said storage space.

Preferably, said resistance generation means is formed by a porous member arranged only on said backward part of said storage space where said opening of said pressurized fluid introducing path on said storage space side is positioned.

Preferably, said resistance generation means is formed by a porous member impregnating a liquid. Said porous member includes a forward porous member and a backward porous member which are installed on said forward part of said storage space where said opening of said liquid leading-out path on said storage space side is positioned and on said backward part of said storage space where said opening of said pressurized fluid introducing path on said storage space side is positioned, respectively. Between said forward porous member installed on said forward part of said storage space and said backward porous member installed on said backward part of said storage space, a space where no porous member is installed exists. A density of said forward porous member is higher than a density of said backward porous member.

Preferably, both said opening of said liquid leading-out path on a storage space side and said opening of said pressurized fluid introducing path on a storage space side are positioned on a forward part of said storage space. Said resistance generation means is composed of a porous member arranged only on said forward part of said storage space.

Preferably, said pressurized fluid introducing path includes a long and narrow flow path for preventing said liquid in said storage space from evaporation of water.

Preferably, a buffer chamber is formed in the middle of said pressurized fluid introducing path, said buffer chamber having a flow path sectional area larger than a flow path sectional area of the other parts of said pressurized fluid introducing path.

Preferably, an on-off valve is installed in said liquid leading-out path, said on-off valve being configured to be opened by a liquid feed needle of said liquid consumption apparatus to be inserted into said liquid leading-out path when said liquid container is mounted on said liquid consumption apparatus.

Preferably, the liquid container further comprises a storage device for storing information on a liquid stored in said storage space, said storage device being arranged in a position opposite to a position of said opening of said pressurized fluid introducing path on said outer surface of said container body with respect to said opening of said liquid leading-out path on said outer surface of said container body.

Preferably, said liquid container is a liquid cartridge removably mounted on said liquid consumption apparatus.

Preferably, said liquid leading-out path and said pressurized fluid introducing path are opened on the same outer surface of said liquid cartridge.

Preferably, said liquid cartridge is an ink cartridge removably mounted on an ink jet recording apparatus.

Preferably, said pressurized fluid is a compressed air.

In the liquid container of the present invention, which is of a type that by a pressurized fluid introduced into the liquid container, the liquid in the liquid container is directly pressurized, the liquid can be prevented from leaking through the opening of the pressurized fluid introducing path opened on the outer surface of the container body when the pressurizing by the pressurized fluid is released.

BRIEF DESCRIPTION OF THE DRAWINGS

The foregoing and other objects, features, and advantages of the present invention will be understood from the following detailed description in connection with the accompanying drawings, in which:

FIG. 4A is a plan view, FIG. 4B and FIG. 4C are side views, FIG. 4D is a bottom view, FIG. 4E is a front view, and FIG. 4F is a rear view;

DESCRIPTION OF THE PREFERRED EMBODIMENTS

Hereinafter, as an embodiment of the liquid container according to the present invention, an ink cartridge for an ink jet recording apparatus will be explained with reference to the accompanying drawings.

Figure 1:
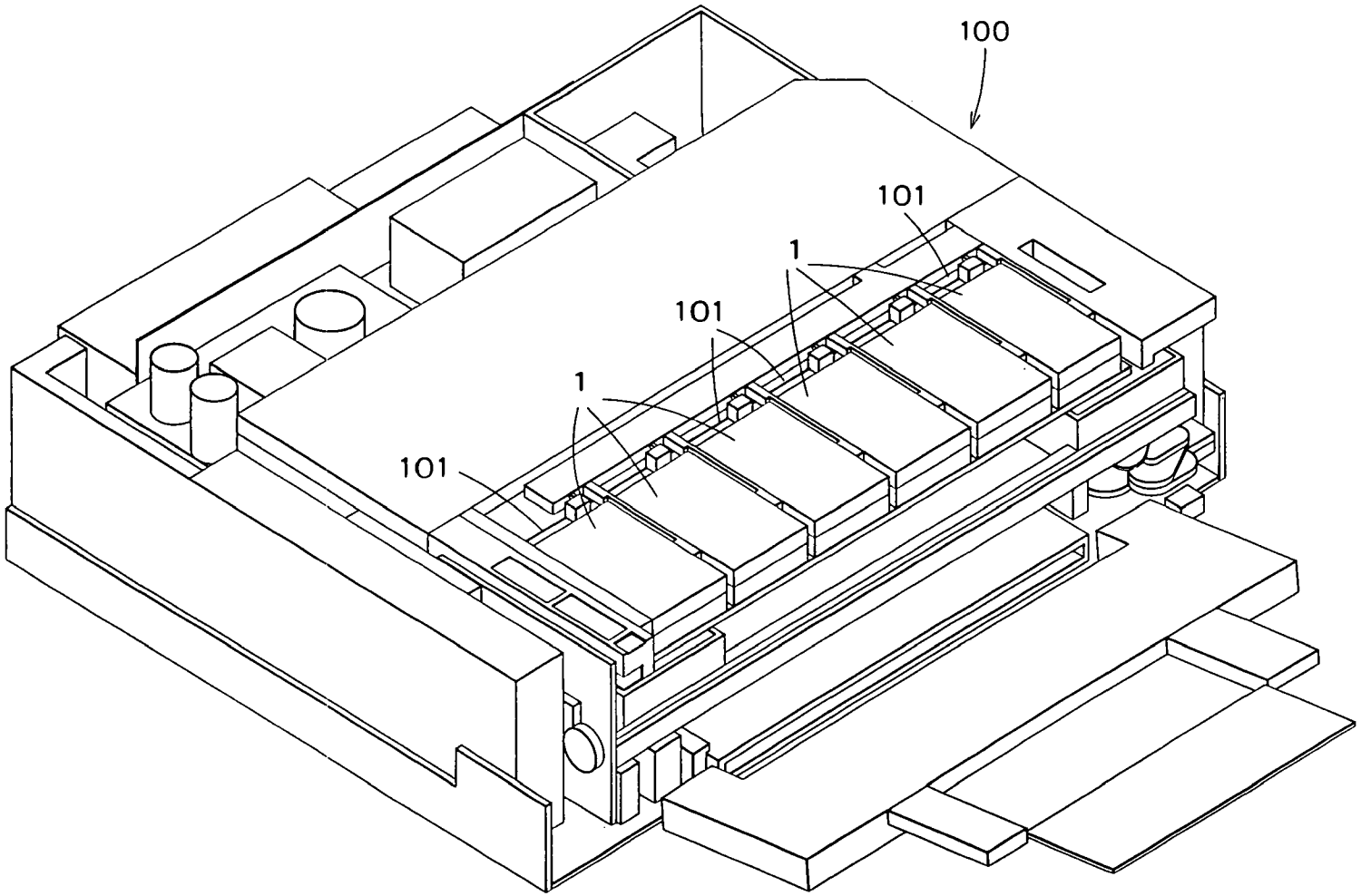
FIG. 1 is a perspective view showing ink cartridges of an embodiment of the present invention and an ink jet recording apparatus on which the ink cartridges are mounted.
Figure 2:
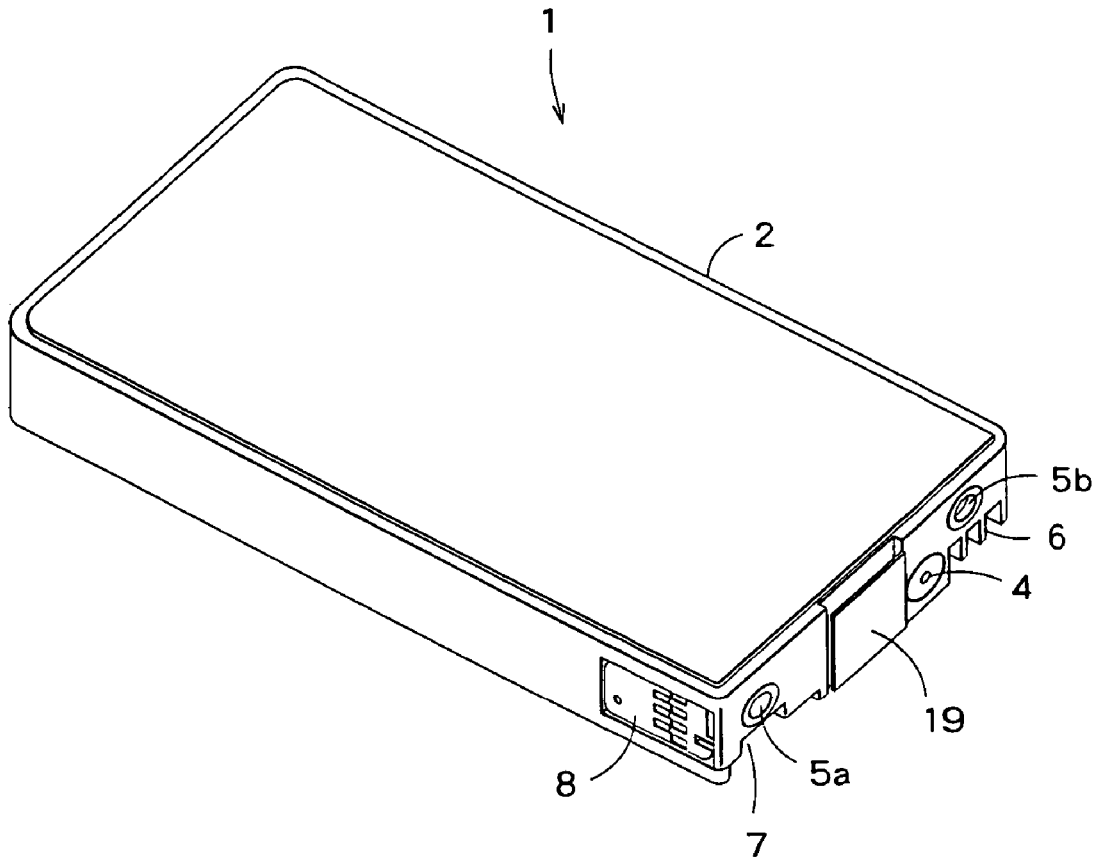
FIG. 2 is a perspective view showing the ink cartridge of the embodiment of the present invention.

FIG. 1 is a perspective view showing ink cartridges 1 of this embodiment and an ink jet recording apparatus 100 having cartridge mounting units 101 where the ink cartridges 1 are mounted. In this example, six cartridge mounting units 101 are installed on the ink jet recording apparatus 100 and the respective cartridge mounting units 101 are opened on the front of the ink jet recording apparatus 100. Further, the six cartridge mounting units 101 are placed side by side on the same horizontal face and six ink cartridges 1 are placed flat side by side.

As shown in FIGS. 2 to 6, the ink cartridge 1 has a container body 2 in a substantially rectangular parallelepiped shape and the container body 2 is composed of a case body 2A whose top is opened and a cover member 2B for sealing the top opening of the case body 2A. At the central part of the front of the container body 2, an ink leading-out port 3 for sending ink to be fed to the ink jet recording apparatus 100 is opened. Similarly, on the front of the container body 2, a compressed air introducing port (pressurized fluid introducing port) 4 for introducing compressed air (pressurized fluid) for pressurizing ink in the container body 2 and sending it from the ink leading-out port 3 into the container body 2 is formed.

Figure 7:
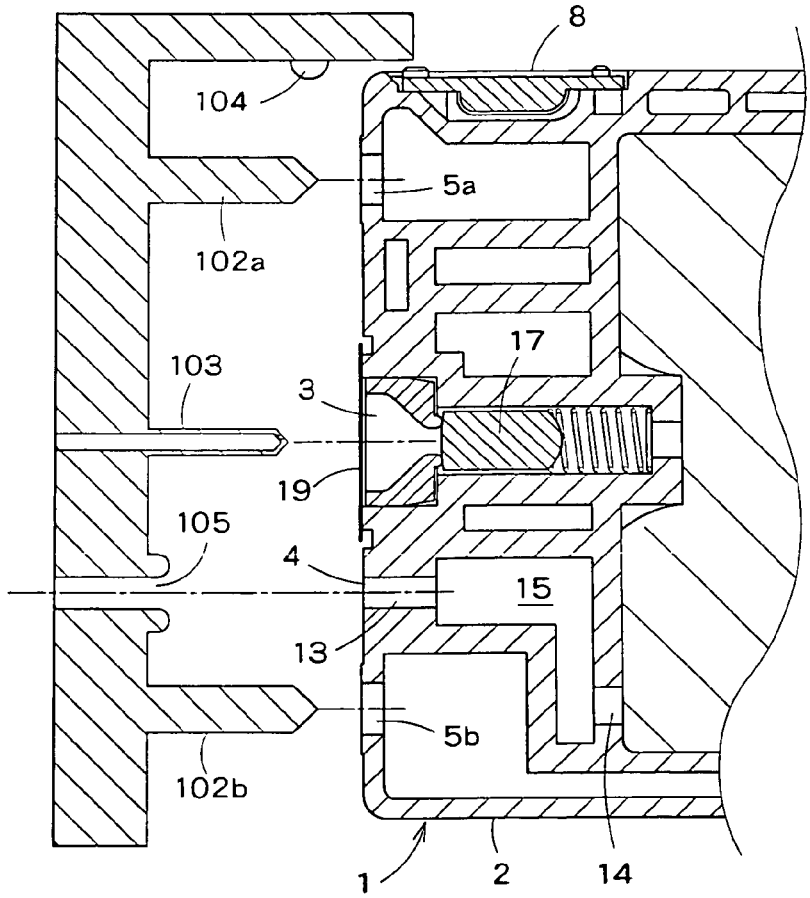
FIG. 7 is a sectional plan view showing the halfway stage of the process of mounting the ink cartridge shown in FIG. 2 in the cartridge mounting unit of the ink jet recording apparatus.
Figure 8:
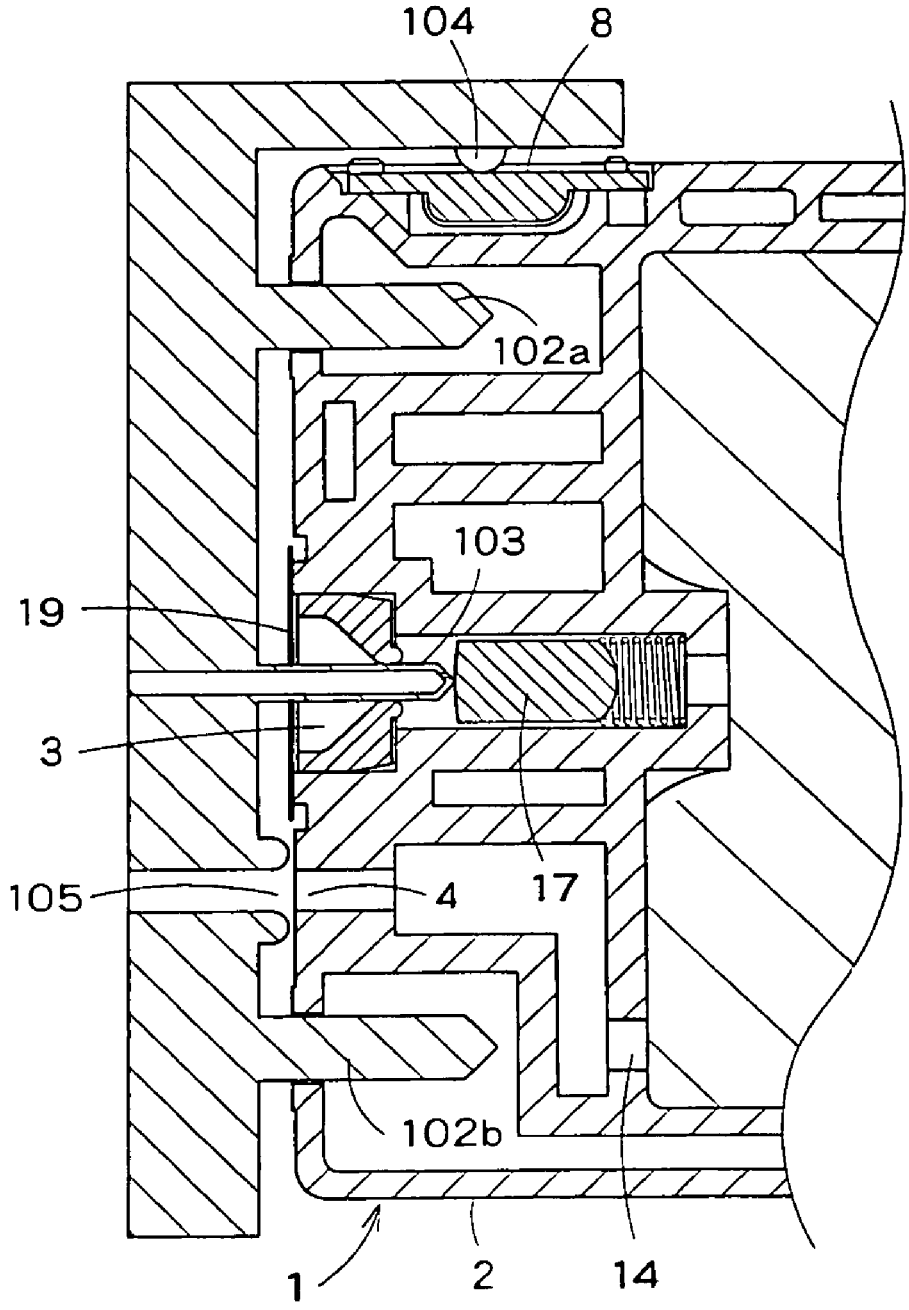
FIG. 8 is a sectional plan view showing the status that the ink cartridge shown in FIG. 2 is mounted in the cartridge mounting unit of the ink jet recording apparatus.

As shown in FIGS. 7 and 8, in each cartridge mounting unit 101 of the ink jet recording apparatus 100, a pair of positioning projections 102*a* and 102*b* is installed, and on the front of the container body 2, a pair of positioning holes 5*a* and 5*b* is formed so that the pair of positioning projections 102*a* and 102*b* is inserted for horizontally positioning the ink cartridge 1.

Further, in one corner of the container body 2 including the front, a malmounting preventive structure 6 is installed. The malmounting preventive structure 6, when mounting the ink cartridges 1 in the ink jet recording apparatus 100, to correctly mount the ink cartridge 1 of a predetermined ink kind in a predetermined position, is shaped not to mount the ink cartridges other than the one of the correct ink kind.

Further, on the bottom of the container body 2, in the neighborhood of the front of the container body 2, in the corner opposite to the corner where the malmounting preventive structure 6 is installed, a cartridge side fixing structure (container fixing mechanism) 7 is installed. The cartridge side fixing structure 7, when the ink cartridge 1 is mounted in the cartridge mounting unit 101, releasably restricts the movement of the ink cartridge 1 in the pull-out direction and retains the ink cartridge 1 in a predetermined position of the cartridge mounting unit 101.

Further, although the cartridge side fixing structure 7 is installed on the bottom of the container body 2 in this embodiment, the position where the cartridge side fixing structure 7 is installed is not limited to the bottom of the container body 2 and for example, it may be arranged on the top of the container body 2.

Further, on one side of the container body 2 close to the cartridge side fixing structure 7, a storage device 8 including a circuit substrate having a mounted IC (semiconductor storage element) for storing information such as the ink kind and residual amount of ink is installed. When mounting the ink cartridge 1 in the cartridge mounting unit 101 of the ink jet recording apparatus 100, as shown in FIGS. 7 and 8, the terminal of the storage device 8 is connected to a contact 104 on the side of the cartridge mounting unit 101.

The storage device 8 is arranged in the position opposite to the position of the compressed air introducing port 4 with respect to the ink leading-out port 3, so that even if ink leaks from the compressed air introducing port 4, the leaked ink is hardly adhered to the storage device 8.

Figure 3:
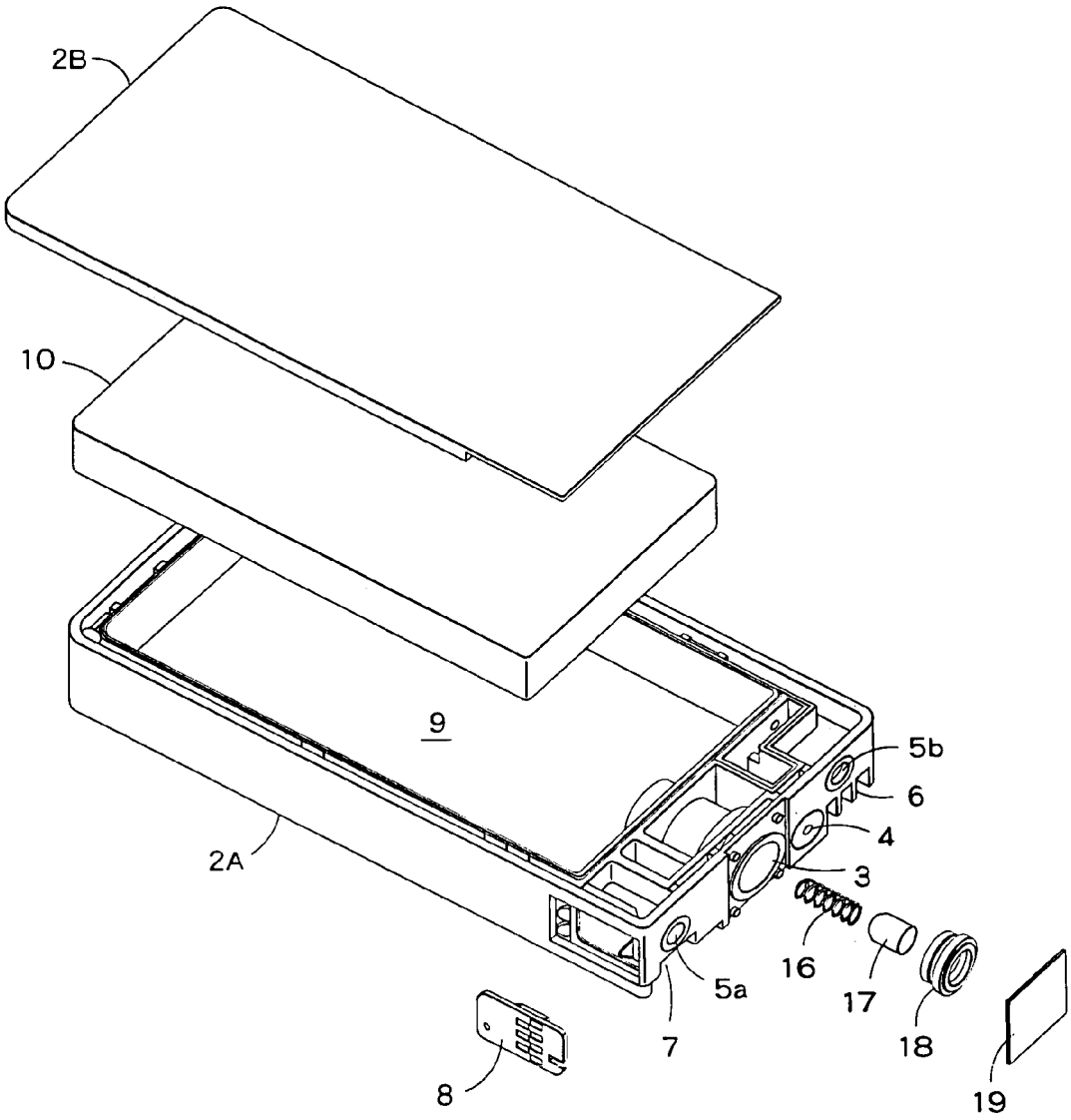
FIG. 3 is an exploded perspective view of the ink cartridge shown in FIG. 2.
Figure 4C:
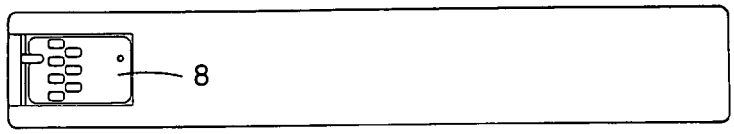
FIGS. 4A to 4F are drawings showing the ink cartridge shown in FIG. 2.
Figures 4A, 4E, 4F:
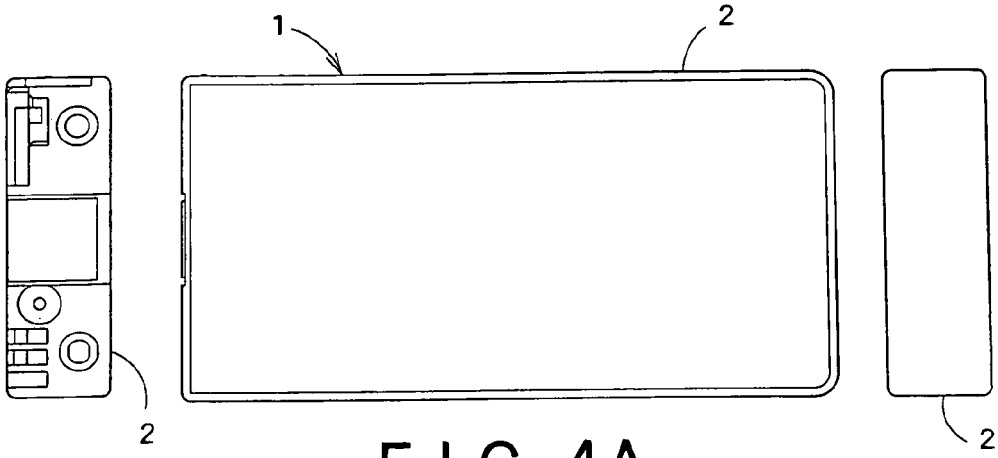
Figure 4B:
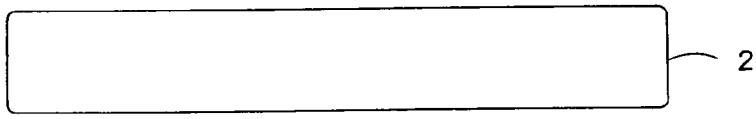
Figure 4D:
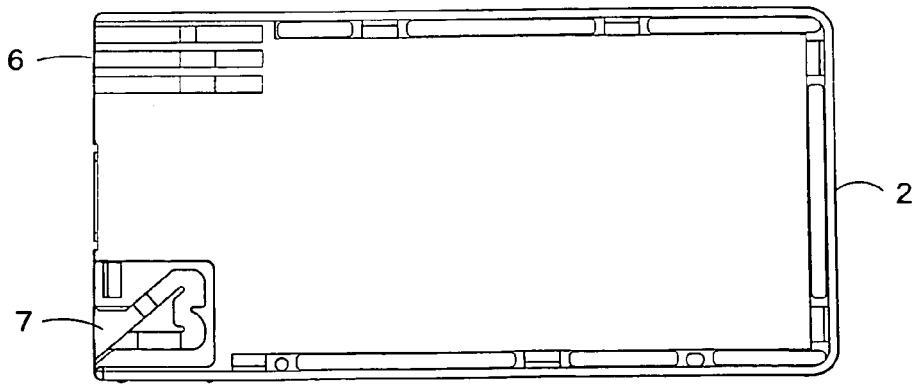
Figure 5:
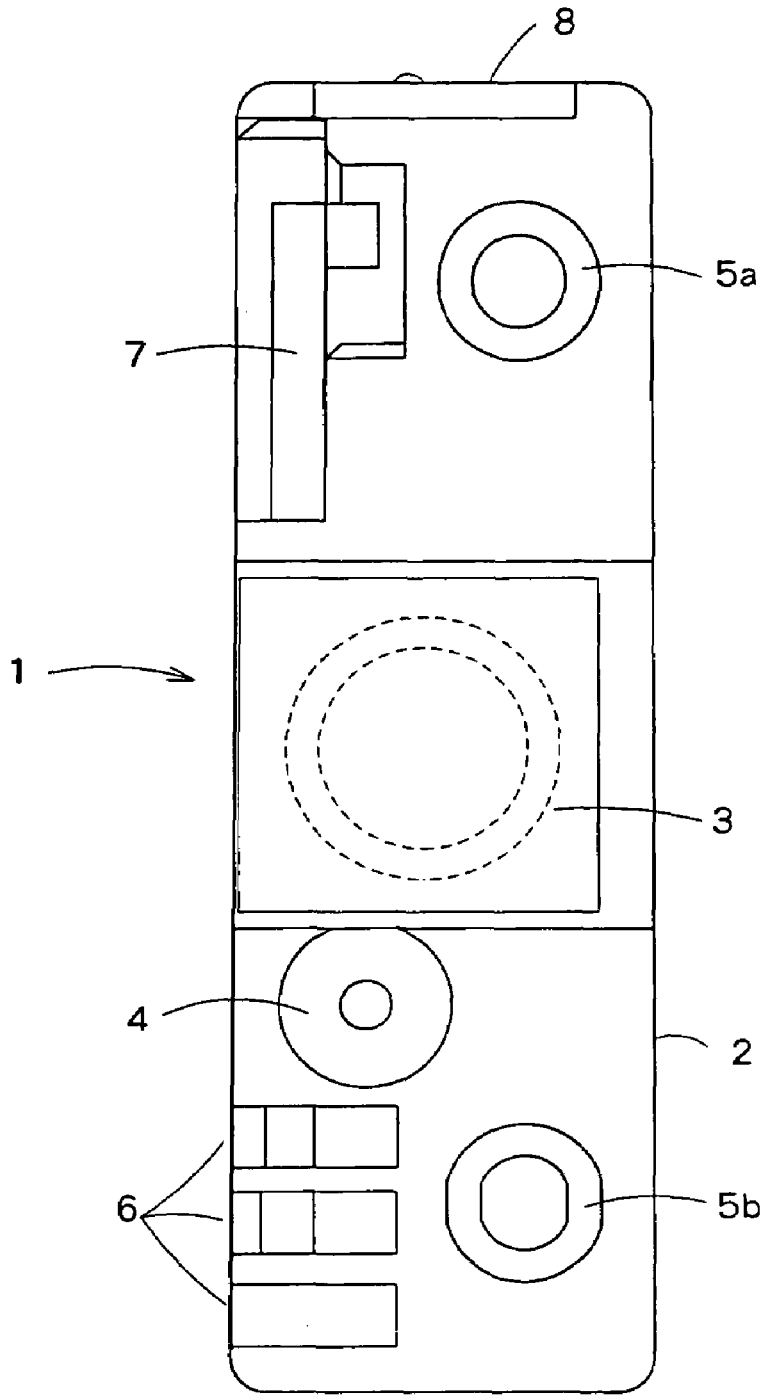
FIG. 5 is an enlarged front view of the ink cartridge shown in FIG. 2.
Figure 6:
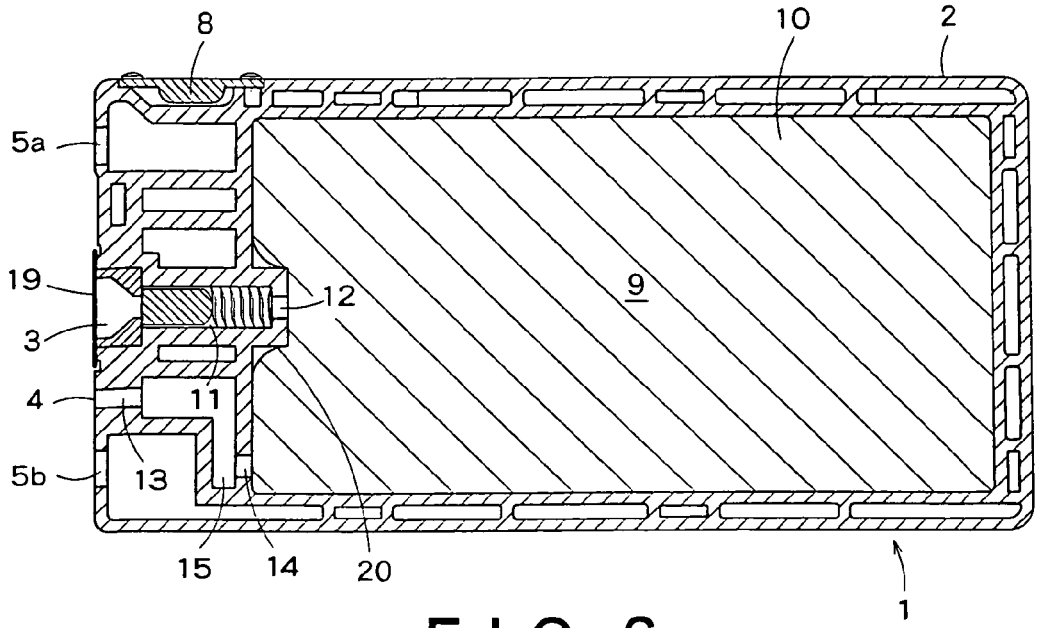
FIG. 6 is a sectional plan view of the ink cartridge shown in FIG. 2.

As shown in FIGS. 3 and 6, inside the container body 2, a storage space 9 for storing ink is formed. The storage space 9 is a closed space formed by sealing the top opening of the case body 2A by the cover member 2B or a film member. For the junction of the cover member 2B to the case body 2A, for example, vibration fusion is used.

Inside the storage space 9, a porous member 10 as a resistance generation means for giving resistance to the flow of ink in the storage space 9 is installed. The porous member 10 is filled in substantially the whole storage space 9 and impregnates ink in the storage space 9.

At the forward part inside the container body 2, an ink leading-out path 11 for sending ink in the storage space 9 to the ink jet recording apparatus 100 is formed. At one end of the ink leading-out path 11, the ink leading-out port 3 opened on the outer surface (front) of the container body 2 is formed and at the other end, a storage space side opening 12 opened in the storage space 9 is formed.

Furthermore, at the forward part inside the container body 2, a compressed air introducing path (pressurized fluid introducing path) 13 for introducing compressed air (pressurized fluid) into the storage space 9 is formed side by side in the ink leading-out path 11. At one end of the compressed air introducing path 13, the compressed air introducing port 4 opened on the outer surface (front) of the container body 2 is formed and at the other end, a storage space side opening 14 opened in the storage space 9 is formed.

As mentioned above, in the ink cartridges 1 in this embodiment, both the ink leading-out port 3 and the compressed air introducing port 4 are opened on the front of the container body 2.

Halfway the compressed air introducing path 13, a buffer chamber 15 having a flow path area larger than that of the other parts is formed. Therefore, even if ink leaks from the storage space side opening 14 of the compressed air introducing path 13, ink is caught by the buffer chamber 15, thus ink can be prevented from leaking from the compressed air introducing port 4 outside the ink cartridge 1. The ink caught by the buffer chamber 15 is returned to the storage space 9 when compressed air is introduced again.

Inside the ink leading-out path 11, a valve body 17 pressed by a spring 16 is arranged, and outside it, a seal member 18 is attached, thus an on-off valve is formed.

In the ink cartridge 1 not in use, the ink leading-out port 3 is sealed by a sealing film 19 and the sealing film 19, when mounting the ink cartridge 1 in the cartridge mounting unit 101 of the ink jet recording apparatus 100, is pierced by an ink feed needle 103 on the apparatus body side shown in FIGS. 7 and 8. Further, by insertion of the ink feed needle 103, the valve body 17 is pushed in, and the on-off valve is opened, and the ink leading-out path 11 is opened. After the ink leading-out path 11 is opened, the compressed air introducing port 4 is connected to a compressed air port 105 on the apparatus body side.

As shown in FIG. 6, the storage space side opening 12 of the ink leading-out path 11 is formed so as to pass through a high-density part forming projection 20 projecting toward the storage space 9. The porous member 10 is locally compressed by the high-density part forming projection 20, thereby, the compressed part and the neighborhood thereof are higher in density than the other parts. Namely, by the existence of the high-density part forming projection 20, in the neighborhood of the storage space side opening 12 of the ink leading-out path 11, the density of the porous member 10 is higher than that in the other parts.

The high-density part forming projection 20 is formed integrally with the container body 2 on the inner wall surface of the storage space 9. Since the high-density part forming projection 20 is formed integrally with the container body 2 like this, the high-density part forming projection 20 can be formed easily at a low cost.

Further, the ink cartridges 1 in this embodiment is of a type that compressed air introduced into the storage space 9 via the compressed air introducing path 13 directly makes contact with ink to pressurize it and is the so-called open system pressurizing type ink cartridge.

And, by the ink cartridges 1 of this embodiment having the aforementioned constitution, when the pressurizing by compressed air is released, even if air in the storage space 9 back-flows and is ejected from the compressed air introducing port 4, the porous member 10 gives resistance to the ink flow in the storage space 9, so that ink can be prevented from leaking from the compressed air introducing port 4 together with air.

Furthermore, by the ink cartridges 1 of this embodiment, even in a case other than release of pressurizing, an ink leak from the compressed air introducing port 4 due to temperature changes and/or posture differences can be prevented, and also an ink leak from the ink leading-out port 3 can be prevented.

Furthermore, in the ink cartridges 1 of this embodiment, the resistance generation means is formed by the porous member 10, so that the resistance generation means can be realized by a simple structure and the manufacturing cost can be suppressed.

Furthermore, in the ink cartridges 1 of this embodiment, by the high-density part forming projection 20, in the neighborhood of the storage space side opening 12 of the ink leading-out path 11, the density of the porous member 10 is made higher than that of the other parts, so that even if ink in the storage space 9 is consumed and the residual amount is decreased, ink collects in the neighborhood of the storage space side opening 12 of the ink leading-out path 11, thus the final residual amount of ink can be reduced.

Next, an ink cartridge of another embodiment of the present invention will be explained by referring to FIG. 9. Further, in this embodiment, the constitution of the aforementioned embodiment shown in FIG. 6 is partially changed and hereinafter, the different parts from the embodiment shown in FIG. 6 will be explained.

Figure 9:
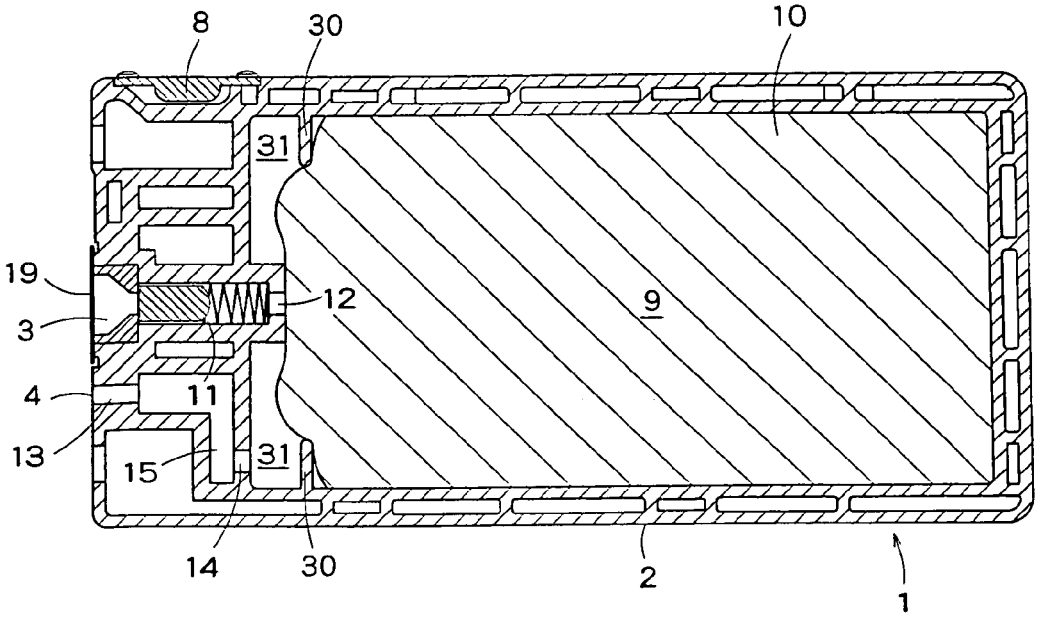
FIG. 9 is a sectional plan view of an ink cartridge of another embodiment of the present invention.

As shown in FIG. 9, in the ink cartridge 1 of this embodiment, at the forward part of the storage space 9, a pair of ribs 30 is projected and formed integrally with the container body 2 on the inner wall of the storage space 9. These ribs 30 form a space reservation projection for compressing the porous member 10 so as to keep it away from the storage space side opening 14 of the compressed air introducing path 13, thereby forming a space, where the porous member 10 does not exist, around the storage space side opening 14.

As mentioned above, in the ink cartridge 1 of this embodiment, the pair of ribs 30 forms a space 31, where the porous member 10 does not exist, around the storage space side opening 14, so that when the pressurizing by compressed air is released, the air in the storage space 9 is smoothly ejected from the storage space side opening 14 outside the storage space 9 via the space 31 where the porous member 10 does not exist without being obstructed by the residual ink. By doing this, ink can be prevented from leaking outside the ink cartridge 1 due to back flow of air at the time of release of pressurizing.

Next, an ink cartridge of still another embodiment of the present invention will be explained by referring to FIG. 10. Further, in this embodiment, the constitution of the aforementioned embodiment shown in FIG. 6 is partially changed and hereinafter, the different parts from the embodiment shown in FIG. 6 will be explained.

Figure 10:
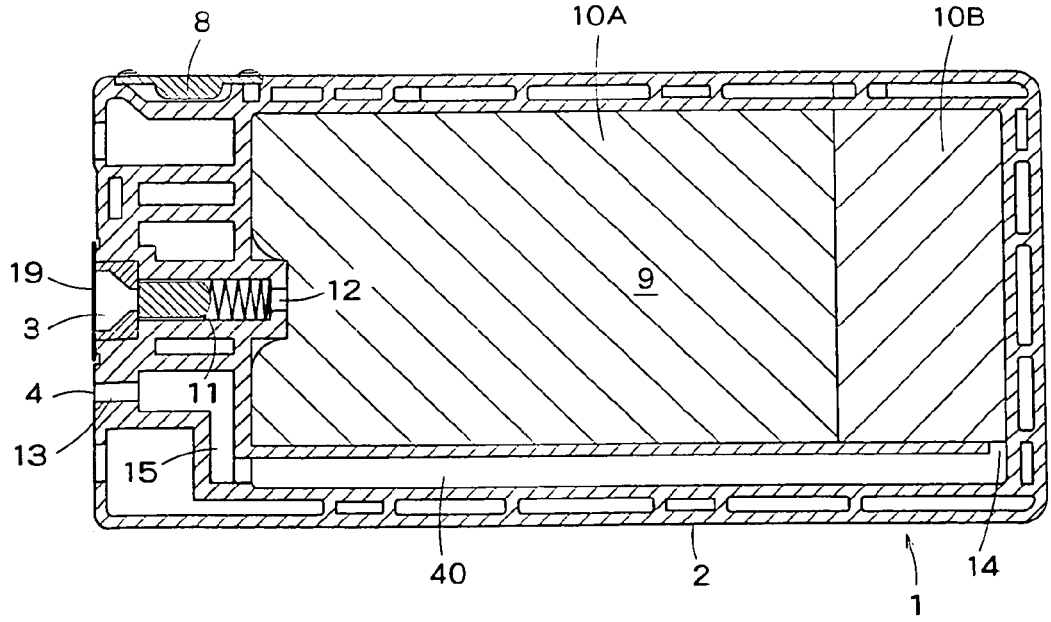
FIG. 10 is a sectional plan view of an ink cartridge of still another embodiment of the present invention.

As shown in FIG. 10, in the ink cartridge 1 of this embodiment, the pressurized fluid introducing path 13 is extended to the rear end of the storage space 9 by a long and narrow flow path 40 extending in the longitudinal direction of the ink cartridge 1 and the storage space side opening 14 of the pressurized fluid introducing path 13 is positioned at the rear end of the storage space 9.

Furthermore, in the ink cartridges 1 of this embodiment, inside the storage space 9, a high-density porous member 10A and a low-density porous member 10B are installed. The high-density porous member 10A is installed within a wide range (a range of about ¾ of the whole storage space) including the forward part of the storage space 9 where the storage space side opening 12 of the ink leading-out path 11 is positioned. On the other hand, the low-density porous member 10B is arranged at the rear end of the storage space 9 where the storage space side opening 14 of the pressurized fluid introducing path 13 is positioned.

As mentioned above, in the ink cartridges 1 of this embodiment, the storage space side opening 12 of the ink leading-out path 11 is positioned at the front end of the storage space 9, while the storage space side opening 14 of the compressed air introducing path 13 is positioned at the rear end of the storage space 9, so that ink is efficiently pressurized by compressed air introduced into the storage space 9 and the final residual amount of ink can be reduced.

Furthermore, in the ink cartridges 1 of this embodiment, the porous member 10B in the neighborhood of the storage space side opening 14 of the compressed air introducing path 13 is formed in lower density than that of the porous member 10A on the other parts, so that ink in the storage space 9 hardly collects around the storage space side opening 14 of the compressed air introducing path 13. Therefore, an air flow path can be easily formed around the storage space side opening 14 of the compressed air introducing path 13 and when the pressurizing is released, air in the storage space 9 is smoothly ejected from the storage space 9 via this flow path. By doing this, when the pressurizing is released, ink can be prevented from leaking from the compressed air introducing port 4.

Furthermore, in the ink cartridges 1 of this embodiment, the pressurized fluid introducing path 13 is extended up to the rear end of the storage space 9 by the long and narrow flow path 40, so that evaporation of water from ink in the storage space 9 is suppressed by the long and narrow flow path 40.

Figure 11:
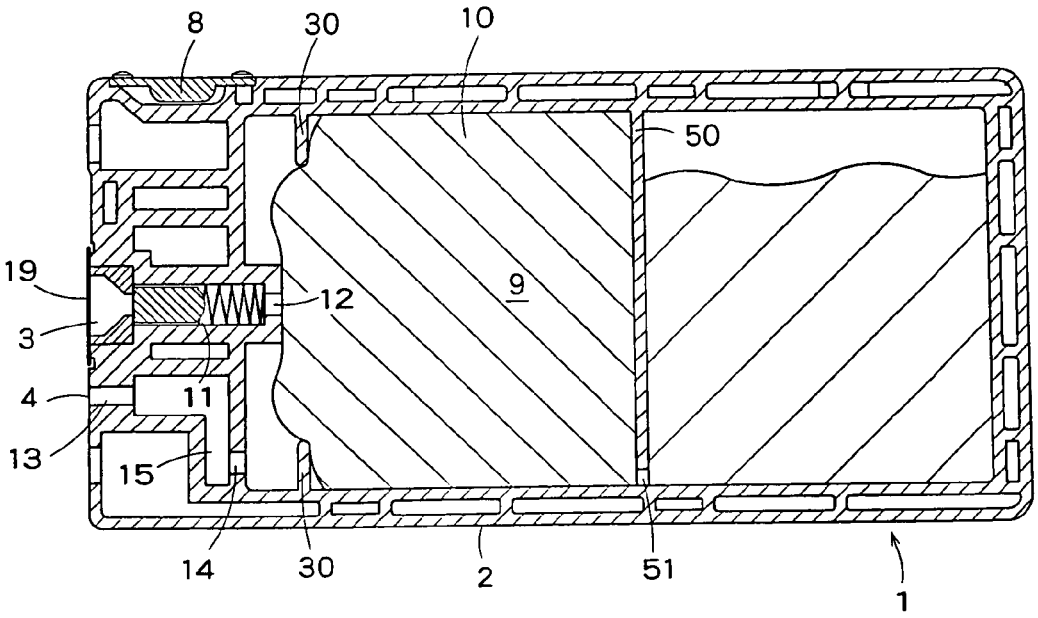
FIG. 11 is a sectional plan view of an ink cartridge of a further embodiment of the present invention.

Next, an ink cartridge of a further embodiment of the present invention will be explained by referring to FIG. 11. Further, in this embodiment, the constitution of the embodiment shown in FIG. 9 is partially changed and hereinafter, the different parts from the embodiment shown in FIG. 9 will be explained.

In the ink cartridges 1 of this embodiment, a partition 50 is installed halfway the storage space 9 in the longitudinal direction. In the partition 50, a through hole 51 interconnecting the backward part and forward part of the storage space 9 is formed. The porous member 10 is installed only at the forward part of the storage space 9 partitioned by the partition 50 and no porous member is installed at the backward part of the storage space 9.

As mentioned above, according to the ink cartridge 1 of this embodiment, the porous member 10 is installed only at the forward part of the storage space 9 where the storage space side opening 14 of the compressed air introducing path 13 is positioned, so that while preventing an ink leak when the pressurizing by compressed air is released, a large ink volume can be reserved in the storage space 9.

Next, an ink cartridge of a still further embodiment of the present invention will be explained by referring to FIG. 12. Further, in this embodiment, the constitution of the embodiment shown in FIG. 10 is partially changed and hereinafter, the different parts from the embodiment shown in FIG. 10 will be explained.

In the ink cartridge 1 of this embodiment, the backward part of the storage space 9 where the storage space side opening 14 of the compressed air introducing path 13 is positioned is partitioned by a partition 60. In the partition 60, a through hole 61 interconnecting the backward part and forward part of the storage space 9 is formed. And, the porous member 10 is installed only at the backward part of the storage space 9 partitioned by the partition 60, and at the part where the high-density porous member 10A is installed in the example shown in FIG. 10, no porous member is installed as shown in FIG. 12.

As mentioned above, according to the ink cartridge 1 of this embodiment, the porous member 10 is installed only at the backward part of the storage space 9 where the storage space side opening 14 of the compressed air introducing path 13 is positioned, so that while preventing an ink leak at the time of release of pressurizing, a large ink volume can be reserved in the storage space 9.

Next, an ink cartridge of yet a further embodiment of the present invention will be explained by referring to FIG. 13. Further, in this embodiment, the constitution of the embodiment shown in FIG. 12 is partially changed and hereinafter, the different parts from the embodiment shown in FIG. 12 will be explained.

Figure 12:
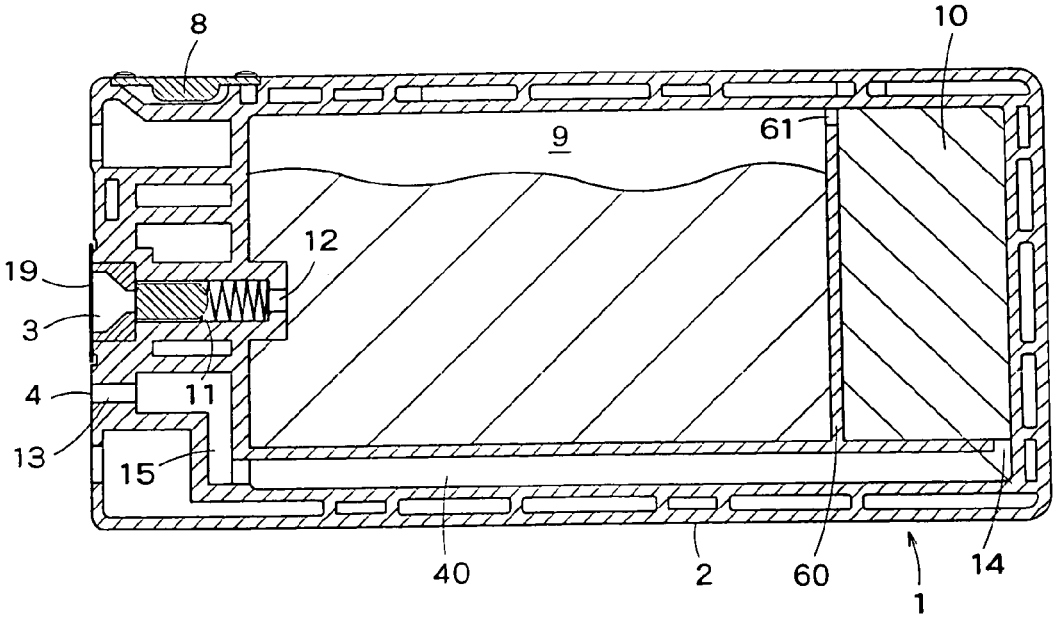
FIG. 12 is a sectional plan view of an ink cartridge of a still further embodiment of the present invention.
Figure 13:
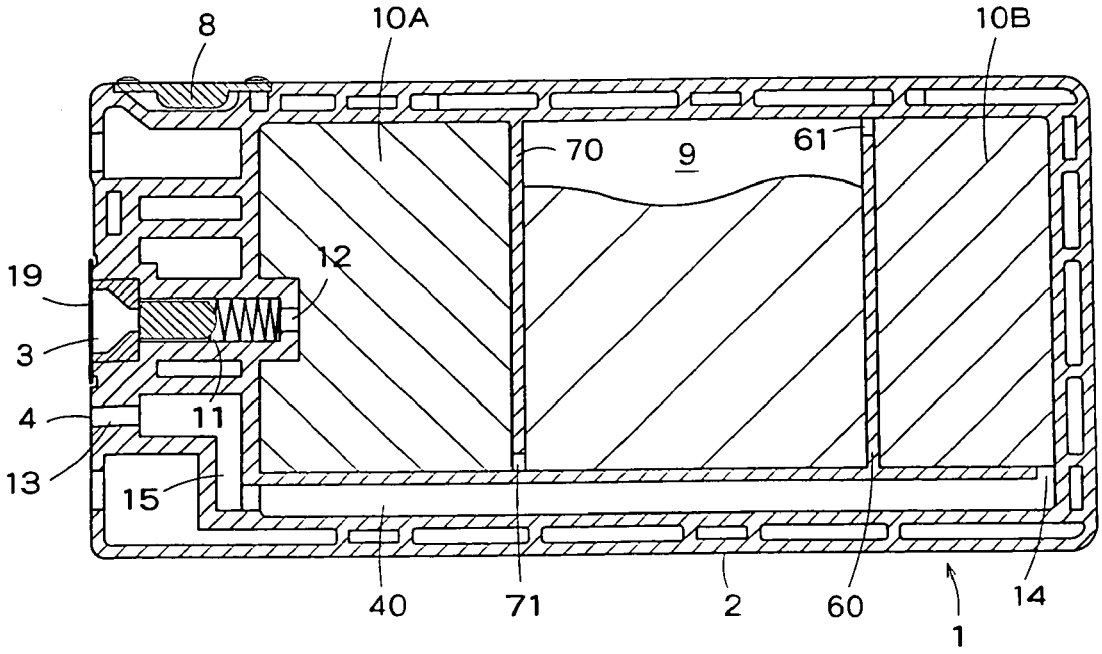
FIG. 13 is a sectional plan view of an ink cartridge of yet a further embodiment of the present invention.

In the ink cartridge 1 of this embodiment, in the constitution shown in FIG. 12, an additional partition 70 having a through hole 71 is installed on the forward side of the partition 60. In the space between the partition 60 and the partition 70, no porous member is installed. Further, the through hole 61 of the partition 60 and the through hole 71 of the partition 70 are arranged on the opposite side of each other in the horizontal direction of the storage space 9.

And, the porous member 10A installed in the space on the forward side partitioned by the partition 70 has a higher density than that of the porous member 10B installed in the space on the backward side partitioned by the partition 60.

As mentioned above, according to the ink cartridge 1 of this embodiment, on the forward part of the storage space 9 including the storage space side opening 12 of the ink introducing path 11, the high-density porous member 10A is installed, so that while reserving a large ink volume in the hollow space between the partition 60 and the partition 70, ink is collected around the storage space side opening 12 of the ink introducing path 11 and the final residual amount of ink can be reduced.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A liquid container for storing a liquid to be fed to a liquid consumption apparatus, comprising:

a container body having a built-in closed storage space for storing the liquid;

a liquid leading-out path for sending the liquid in said storage space to the liquid consumption apparatus, an opening at one end thereof being opened on an outer surface of said container body and an opening at the other end thereof being opened in said storage space;

a pressurized fluid introducing path for introducing a pressurized fluid into said storage space, an opening at one end thereof being opened on said outer surface of said container body and an opening at the other end thereof being opened in said storage space; and a resistance generation device arranged in said storage space to resist a liquid flow from said storage space, wherein a buffer chamber is formed in the middle of said pressurized fluid introducing path, said buffer chamber having a flow path sectional area larger than a flow path sectional area of other parts of said pressurized fluid introducing path.

* * * * *